US006377216B1

(12) United States Patent
Cheadle et al.

(10) Patent No.: US 6,377,216 B1
(45) Date of Patent: Apr. 23, 2002

(54) INTEGRAL ANTENNA CONFORMABLE IN THREE DIMENSIONS

(75) Inventors: Nancy A. Cheadle; Jennifer W. Kerns, both of Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/548,841

(22) Filed: Apr. 13, 2000

(51) Int. Cl.[7] ..... H01Q 1/38
(52) U.S. Cl. ..... 343/700 MS; 343/718
(58) Field of Search ..... 343/718, 700 MS, 343/912; H01Q 1/38

(56) References Cited

U.S. PATENT DOCUMENTS 3,823,403 A * 7/1974 Walter et al. ..... 343/718
4,584,707 A 4/1986 Goldbert et al.
4,722,860 A 2/1988 Doljack et al.
5,155,493 A * 10/1992 Thursby et al. ..... 343/700 MS
5,723,186 A 3/1998 Fraser, Jr.
5,874,919 A 2/1999 Rawnick et al.
5,884,198 A 3/1999 Kese et al.
5,906,004 A 5/1999 Lebby et al.
5,949,384 A 9/1999 Ikushima
5,959,595 A * 9/1999 Witschen et al. ..... 343/912

* cited by examiner

*Primary Examiner*—Michael C. Wimer
(74) *Attorney, Agent, or Firm*—Earl Baugher; Anthony J. Serventi; David Kalmbaugh

(57) ABSTRACT

Provided is a low-cost robust antenna that may be discreetly integrated into an article of clothing so that it may be suitable for comfortable use with that article of clothing. The antenna is fabricated from off-the-shelf materials, some of which are commonly available at retail outlets. It may provide the same wear as a good quality piece of clothing. It also reduces electromagnetic coupling with the wearer's body, reduces apparel weight and bulk, and increases performance when compared to comparable existing systems. The frequency response, gain, or size and shape of the antenna are adjustable, within reason, to user requirements.

25 Claims, 4 Drawing Sheets

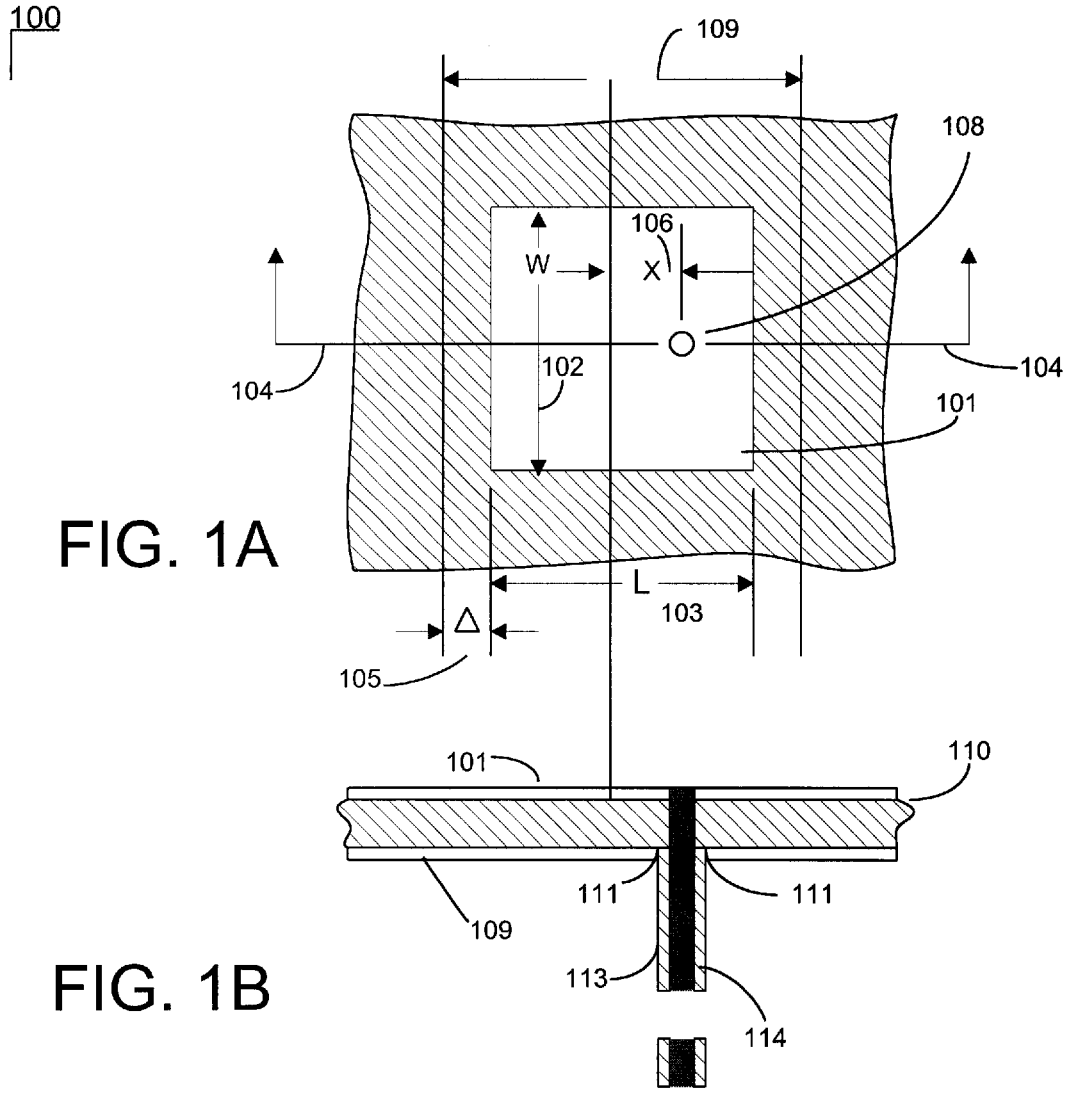
FIG. 1A
FIG. 1B
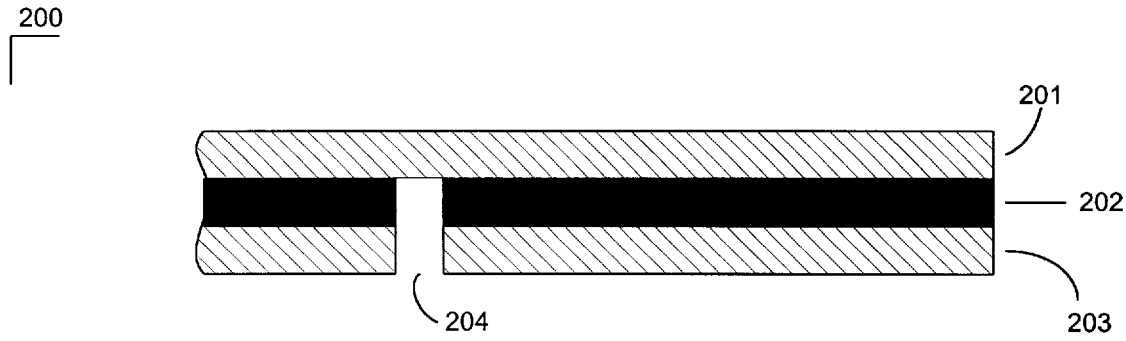
FIG. 2

INTEGRAL ANTENNA CONFORMABLE IN THREE DIMENSIONS

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The present invention pertains to an antenna. In particular, a preferred embodiment is an antenna that is integrated into an object while readily and inconspicuously conforming to irregular soft shapes, such as the human body or an inflatable craft.

BACKGROUND

Antennas, even so-called conformable antennas, are conventionally fabricated using a relatively inflexible base material. That is to say, the base material may be somewhat flexible in one direction or in one plane, but not easily conformable in all three of its dimensions simultaneously and instantaneously. In other words, these antennas would not be suitable for comfortable active wear as an undergarment, for example. Further, should an antenna be desired for incorporation in a relatively soft object such as an inflatable lifeboat or a weather balloon, the rigid nature of conventional antennas could cause unintended damage when the lifeboat or balloon is subject to buffeting, sudden compression, or abrasion.

Another disadvantage of "hard" portable antennas is that when placed in proximity to the human body, electromagnetic coupling with the body degrades antenna performance. Should one desire to reduce or eliminate this coupling, a relatively large ground plane inserted between the antenna and the body is desirable. Using conventional designs, this ground plane would add unnecessary bulk, weight, and cost while reducing mobility of the human or performance of soft objects such as lifeboats and weather balloons.

There are available specialized fabrics capable of conducting electromagnetic energy. For example, U.S. Pat. No. 4,722,860, Carbon Film Coated Refractory Fiber Cloth, issued to Doljack et al, Feb. 2, 1988 provides an electrically conductive fabric suitable for use at high temperatures such as might be experienced in electric blankets or as screens for microwave ovens. Processes for coating fabric to change its electrical conductivity while retaining flexibility are evidenced in U.S. Pat. No. 5,723,186, Conductive Fabric and Process for Making Same, issued to Fraser, Mar. 3, 1998, and U.S. Pat. No. 5,804,291, same title and inventor as the '186 patent, Sep. 8, 1998. Further, U.S. Pat. No. 5,906,004, Textile Fabric with Integrated Electrically Conductive Fibers and Clothing Fabricated Thereof, issued to Lebby et al, May 25, 1999, provides electrically conductive clothing.

Additionally, there is specialized clothing incorporating readily apparent (to the naked eye) electrical components such as antennas and radios. See U.S. Pat. No. 4,584,707, Cordless Communication System, issued to Goldberg et al, Apr. 22, 1986, and U.S. Patent 5,884,198, Body Conformable Portable Radio and Method of Constructing the Same, issued to Kese et al, Mar. 16, 1999. Although each of these inventions are at least partially incorporated in clothing, their presence is readily observable due to bulk, configuration, or both. That is, they do not conform to the plane of the cloth in which they are integrated.

Antennas of recent design intended for portability still incorporate inflexible components. For example, see U.S. Pat. No. 5,874,919, Stub-Tuned Proximity-Fed, Stacked Patch Antenna, issued to Rawnick et al, Feb. 23, 1999, and U.S. Pat. No. 5,949,384, Antenna Apparatus, issued to Ikushima, Sep. 7, 1999. The '919 patent, describes an unconventional design offering performance improvements over existing patch antennas but still incorporating a majority of inflexible components. The '384 patent provides a flexible portable antenna that has no provision for incorporation in an article of clothing or even in layers of cloth. The '384 patent provides for a relatively large antenna that can be folded for transportation, but otherwise is not suitable for continuous wear, for example. Both the '919 and the '384 patents describe very recent antenna technology for use in small spaces or as a portable device but not entirely suitable for discreet insertion in a piece of everyday apparel.

Consequently, what is needed is a truly flexible antenna, suited to wear as an article of clothing or incorporation in the fabric of an inflatable such as a lifeboat or a weather balloon. The antenna should be low-cost, robust, and provide a sufficiently large ground plane to prevent unnecessary coupling to human or animal bodies. Further, the antenna should be able to be cleaned, using common methods, if provided as an article of clothing. The antenna can be provided with a suitable connector to enable use with a variety of communications, navigation, medical, emergency, security, and rescue systems, as defined by the user. A preferred embodiment of the present invention addresses these needs.

SUMMARY OF THE INVENTION

A preferred embodiment of the present invention comprises a flexible patch antenna in a bonded three-layer fabric configuration. A top layer comprises the antenna, a middle layer comprises a dielectric used as an electrical insulator between the top and bottom layers, and a bottom layer comprises a ground plane for the antenna. The three layers are bonded together using a commercial off-the-shelf (COTS) cloth adhesive. In addition, a COTS connector is affixed to the top (non-ground plane) layer for providing electrical communication to a suitable electronic device such as a communications radio or an emergency beacon. Alternatively, the antenna is fed by a miniature waveguide or similar device. The device that will use the antenna is grounded to the ground plane of the antenna, most often through an element of the connector, such as a connection to coax cable shielding.

In a preferred embodiment of the present invention the top and bottom layers are fabricated from a COTS ripstop nylon impregnated with conducting metal fibers, the middle layer is a COTS polyester felt, and the COTS connector is mounted on COTS conducting fabric such as the ripstop nylon of the top layer, and sewn or glued into the top layer. The antenna and ground plane sections are sized to optimize reception/transmission of the operating frequencies of an attached electronic device.

Advantages of preferred embodiments of the present invention, include:

- available for use at a variety of operating frequencies;
- instantaneously flexible in three dimensions;
- greatly reduced coupling to human or animal bodies;
- enhanced performance over conventional designs;
- increased operational flexibility;
- modular and adaptable to a variety of missions;
- robust;

cleanable using commonly available methods;

simplified design of alternate configurations using COTS parts;

uncomplicated fabrication;

reduced system bulk, complexity and weight;

reduced capital costs via use of COTS parts;

low maintenance costs;

high reliability; and ready upgradability.

Embodiments of the present invention can be employed in jackets, shirts, pants, overalls, and other garments. The applications also include sails for sailboats, coverings for non-metallic boats such as wood, fiberglass, or those using a fabric as part of their structure, such as inflatable lifeboats or other small marine craft. It also can be used with hot air balloons, parachutes, weather balloons, flags, wristbands, hats, helmets, integrated security tags, unmanned aerial vehicles (UAVs), combat aerial vehicles (CAVs), hang gliders, and remotely powered vehicles (RPVs). The electronic systems accommodated by a preferred embodiment of the present invention include: emergency locator systems (ELS), communication (COMM) systems, direction finding (DF) systems, global positioning systems (GPS), navigation (NAV) systems, medical identification and monitoring systems (MIMS), and radio location systems (RLS). This configuration saves capital equipment, as well as replacement and maintenance, costs. Further, a preferred embodiment of the present invention may be used in a variety of military, police, rescue, medical, environmental, scientific, security, and commercial roles not enumerated above.

Preferred embodiments are fully disclosed below, albeit without placing limitations thereon.

BRIEF DESCRIPTION OF DRAWINGS

FIG. 1A shows a top view of the physical configuration of a preferred embodiment the present invention.

FIG. 1B shows an edge view of the physical configuration of a preferred embodiment of the present invention, including a grounding connection.

FIG. 2 shows the three-layer configuration of flexible materials comprising a preferred embodiment of the present invention.

DETAILED DESCRIPTION

Figure 3:
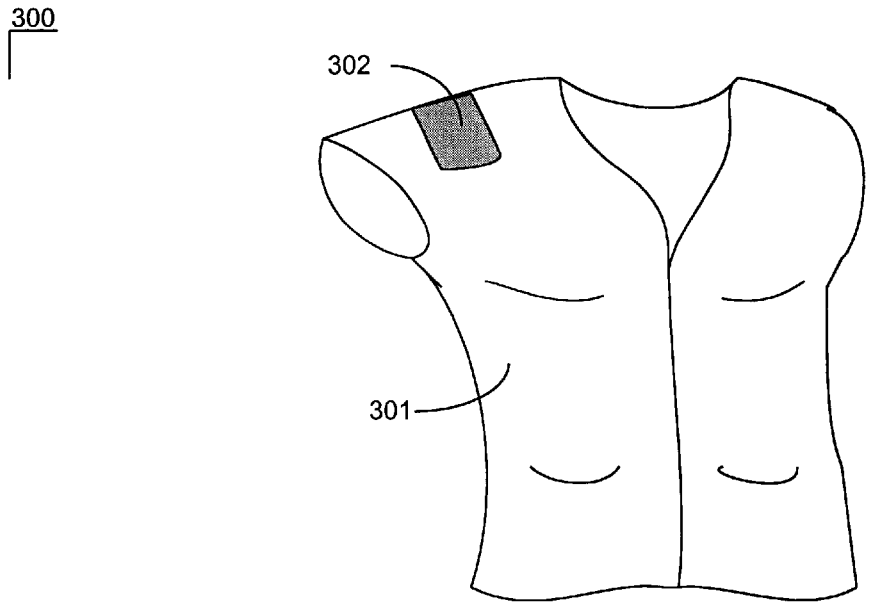
FIG. 3 represents a preferred embodiment of the present invention used as an article of clothing.

The theory behind antenna design is straightforward. Using a patch antenna as an example, the design is iterative, using the following procedure:

$$\text{first estimate: } W = \frac{c}{2f\sqrt{\varepsilon_r}} \tag{1}$$

where:

W=width of rectangular antenna, meters (m)

c=speed of light, m/sec f=frequency of operation, Hertz (Hz)

$\epsilon_r$=permittivity (a constant)

$$\varepsilon_{eff} = \frac{\varepsilon_r + 1}{2} + \frac{\varepsilon_r - 1}{2}\left(1 + \frac{10H}{W}\right)^{\frac{1}{2}} \tag{2}$$

where:

$\epsilon_{eff}$=effective permitivity

H=height of antenna, m $$\frac{\Delta}{H} = 0.412\,\frac{\varepsilon_{eff} + 0.300\,\frac{W}{H} + 0.262}{\varepsilon_{eff} - 0.258\,\frac{W}{H} + 0.813} \tag{3}$$

where:

Δ=overlap of dielectric for effective length of antenna, m $$L = \frac{c}{2f\sqrt{\varepsilon_{eff}}} - 2\Delta \tag{4}$$

where:

L=electrical length of rectangular antenna plane, m $$G = \frac{\pi W}{\eta\lambda_0}\left[1 - \frac{(kH)^2}{24}\right] \tag{5}$$

where:

G=conductance, $(\text{ohms})^{-1}$ or mhos

η=antenna efficiency, $$\sqrt{\frac{\mu_0}{\varepsilon_r}}$$

$\mu_0$=permeability at $\lambda_0$ $\lambda_0$=wavelength at center frequency, m k=radiation efficiency factor, $$\frac{2\pi}{\lambda_0}$$

$$R = \frac{1}{2G} \tag{6}$$

where:

R=resistance of antenna, ohms (Ω)

$$B = 0.01668\frac{\Delta}{H}\left(\frac{W}{\lambda_0}\right)\varepsilon_{eff} \tag{7}$$

where:

B=capacitive susceptance $$R_i = R\sin^2\left(\frac{\pi X}{L}\right) \tag{8}$$

where:

$R_i$=antenna feed point or $$X = \frac{L}{\pi}\sin^{-1}\sqrt{\frac{R_i}{R}} \tag{9}$$

where:

X=arbitrary distance from center line of the width of antenna, m

Referring to FIG. 1A, the conductive patch 101 for the antenna 100 is sized using the above equations in an iterative process. The patch 101 lies in a plane having a width, W 102, and a length, L 103. To establish these dimensions for an antenna polarized along the plane of the conductive patch 101 in the direction of W 102, as shown via arrows 104, values for Δ 105 and X 106 are tried, given a desired effective electrical length, $L_{eff}$ 107, in order to determine the feed point 108 for the antenna 100.

The position of the feed point 108 relative to the edge of the antenna patch 101 determines the input impedance of the antenna 100. For a typical design, L 103=λ/2, where λ is the wavelength corresponding to the operating frequency of the antenna 100. This design forms an open circuit resonator. Given a sufficient value of W 102, the antenna patch 101 edges at x=L/2 and −L/2 form slot apertures that radiate in phase to form a broadside radiation pattern.

In a preferred embodiment of the present invention, the conductive patch 101 is a piece of metallized ripstop fabric manufactured by Swift Textile Metalizing Corporation, 23 Britton Dr., Bloomfield, Conn. 06002-3616. Referring to FIG. 1B, the conductive ground plane 109, shown as the bottom layer of a 3-layer sandwich, is also a piece of metallized ripstop fabric manufactured by Swift Textile Metal Corporation. The dielectric layer 110 is a piece of polyester felt commercially available at any retail fabric outlet. The center feed connection 108 is the point of attachment on the conductive patch 101 of a connector (not completely shown) for an external device (not shown). In FIG. 1B, the ground connection is shown from a conductive outer casing 113 of a coaxial cable to a point 111 on the ground plane 109, the interior of which carries the feed 112 surrounded by a dielectric covering 114 for the antenna 100. Although shown as a single layer of material in FIG. 1B, the dielectric layer 110 may be comprised of multiple layers of fabric as necessary to electromagnetically insulate the two conductive layers 101 and 109 one from the other. In prototypes developed for a preferred embodiment of the present invention, as many as 8 layers of polyester fabric were incorporated in the dielectric layer 110.

FIG. 2 depicts the typical 3-element plane 200 that comprises a preferred embodiment of the present invention. The active antenna plane 201 may consist of one or more layers of "metalized cloth" as can the ground plane 203. Each layer of metalized cloth does not necessarily have to comprise the same type of material and neither the active antenna plane 201 nor the ground plane 203 need comprise the same materials or number of layers of metalized fabric. The non-conducting plane 202 is comprised of one or more layers of non-electrically conductive (dielectric) material such as a common felt. The feed location 204 shown in the ground plane 203 provides a location for connecting an external device (not separately shown) to a preferred embodiment of the present invention.

FIG. 3 depicts an operational antenna 300 as a piece of clothing 301 having the antenna 302 integrally incorporated therein, perhaps in an inconspicuous fashion by matching external fabric colors and texture.

In a preferred embodiment of the present invention, the antenna 302 is integrated into the fabric by stitching the antenna 302 into the garment or piece of clothing 301 to create a camouflage effect for the operational antenna 300. In a more preferred embodiment, this camouflage effect is further accomplished by using the same fabric or cloth for the antenna 302 and the garment or piece of clothing 301. In addition, by stitching the antenna 302 into the fabric or cloth of the garment or piece of clothing 301, the antenna 302 becomes a swatch of the fabric or cloth, rather than a separate unit affixed to the garment or piece of clothing 301. Similarly, the antenna 302 may be integrated into other fabric or cloth articles such as sails, parachutes, weather balloons, flags, wristbands, hats and any other item that can be constructed of cloth. Possible fabrics may include but are not limited to cotton, wool, polyester, felt, gabardine, POLARTEC®, GORE-TEX®, chin, broadcloth, canvas, and any combination thereof.

Figure 4:
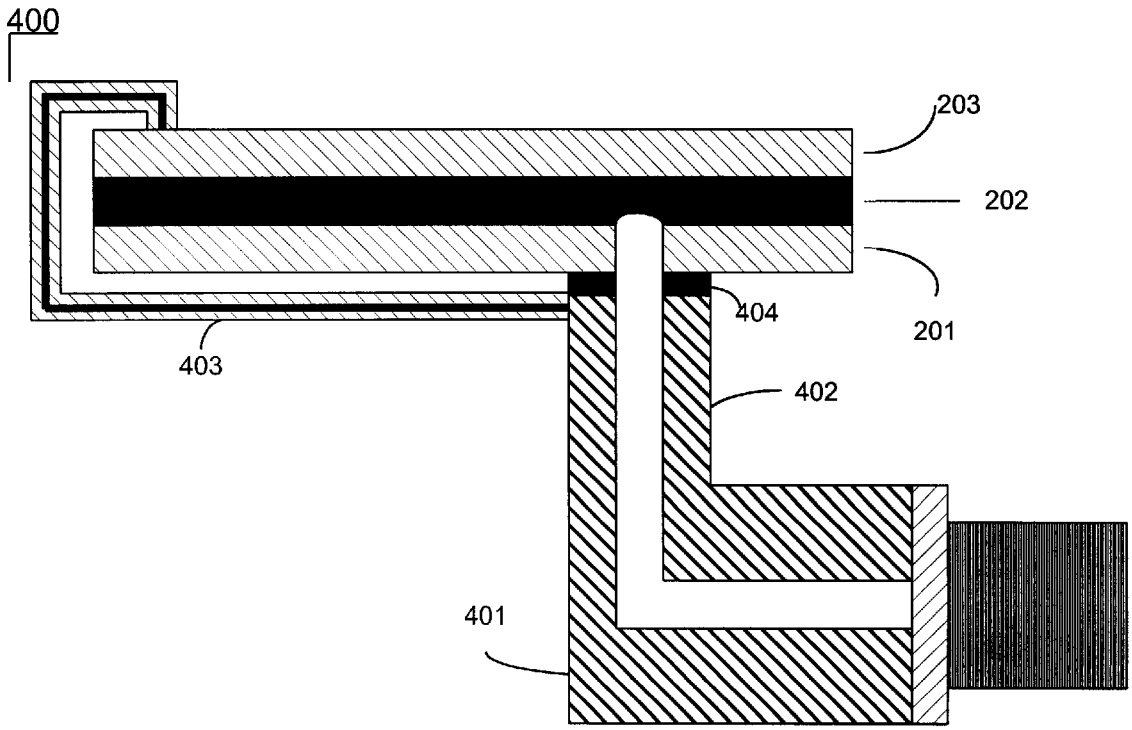
FIG. 4 shows a representative connector, and its installation, for a preferred embodiment of the present invention.

FIG. 4 depicts an example complete embodiment 400 of the present invention incorporating a coaxial connector 401 used to connect an external device. To improve comfort for the wearer, the coaxial connector is connected via an elbow 402 to the active antenna plane 201. This connection is electrically insulated from the ground plane 203 by the dielectric layer 202 and a gasket 404 of dielectric material that insulates the exterior of the coax cable 401 from the active antenna 201. The outside of the coaxial connector 401 is connected via a ground wire 403 to provide a common ground (shown separately for clarity only) for the external device to the ground plane 203 of the antenna.

EXAMPLE

For an initial configuration, design parameters were copied from an existing conventional, i.e., relatively inflexible in three dimensions, patch antenna. This flexible patch antenna 100 is fabricated from the ripstop material identified above for the conductive layers 101 and 109 and a relatively thin material known generically as "embroidery stabilizer," having the trade name CUT-AWAY PLUS™, for the dielectric layer 110. The antenna was constructed as follows:

a. Four thicknesses of CUT-AWAY PLUS™ were fused together with an adhesive to serve as the dielectric layer 110. It was estimated that four thicknesses were needed to provide the required dielectric strength. Bonding was achieved with an adhesive having the trade name FUSEBOND™.

b. A single layer of ripstop fabric was fused to one side of this dielectric layer 110, serving as the conductive ground patch 109, and an appropriately sized piece of ripstop fabric was fused to the other side of this dielectric layer to serve as the conductive patch 101.

c. An antenna feed was located on the surface of the conductive patch 101 in keeping with the conventional antenna's design noted above. Through the ground conductive layer 109 and the dielectric layer 110, a coaxial cable 113, having properly grounded shielding 112, was attached to the antenna 100 as shown in FIG. 1B and used to feed a signal to the antenna 100.

Characteristics of this antenna 100 were then measured, yielding radiation (Gain, dB as a function of angle, θ, off boresite of the antenna for the polarization at which it was measured) and impedance (resistance, Ω) parameters as well as the critical design parameter of relative permitivity, $\epsilon_r$. Having an estimate of $\epsilon_r$, the conductive patch 101 dimensions, including feed location 108, are adjusted for optimum performance. In addition, the dielectric strength of the dielectric layer 110 is adjusted by altering the number of layers of CUT-AWAY PLUS™. Having determined that multiple thicknesses of CUT-AWAY PLUS™ are needed in most cases, a thicker polyester felt was selected in order to reduce the number of thicknesses required for the dielectric layer 110. Performance characteristics of Gain vs. θ for various permutations of the basic design are provided in FIGS. 5–6.

EXAMPLE

Figure 5A:
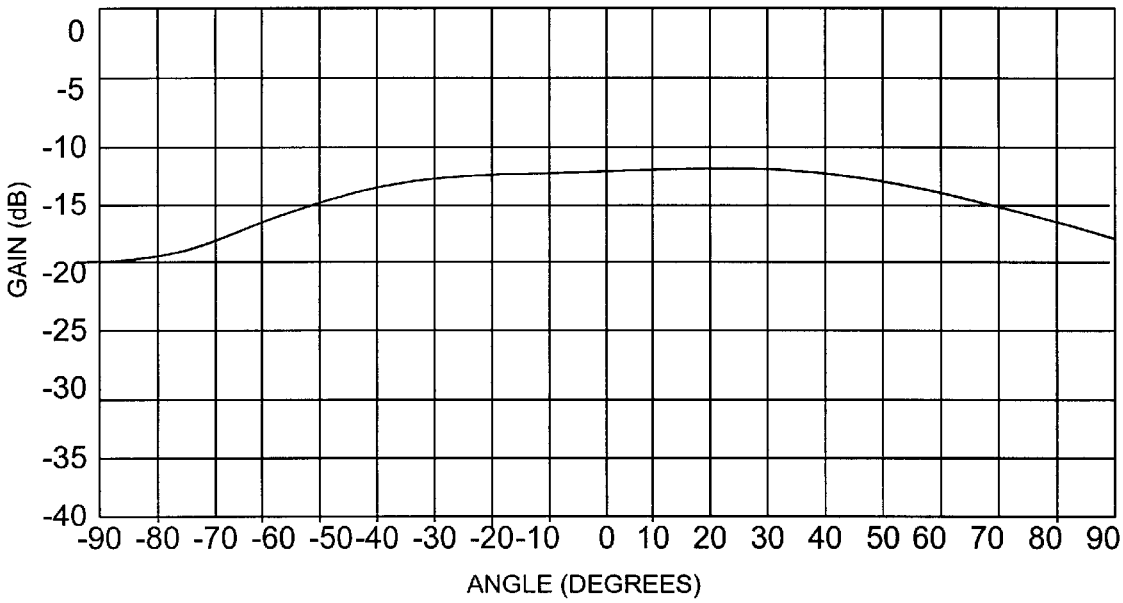
FIG. 5A shows the antenna response for a horizontally polarized half-fab configuration of a preferred embodiment of the present invention.
Figure 5B:
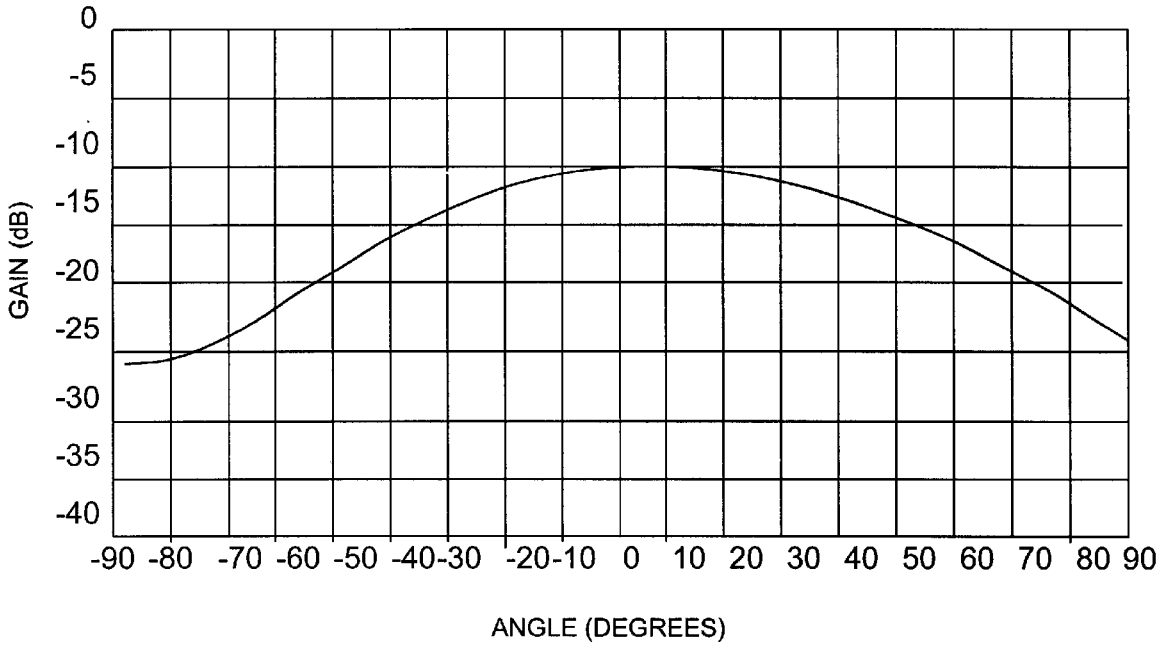
FIG. 5B shows the antenna response for a vertically polarized half-fab configuration of a preferred embodiment of the present invention.
Figure 6A:
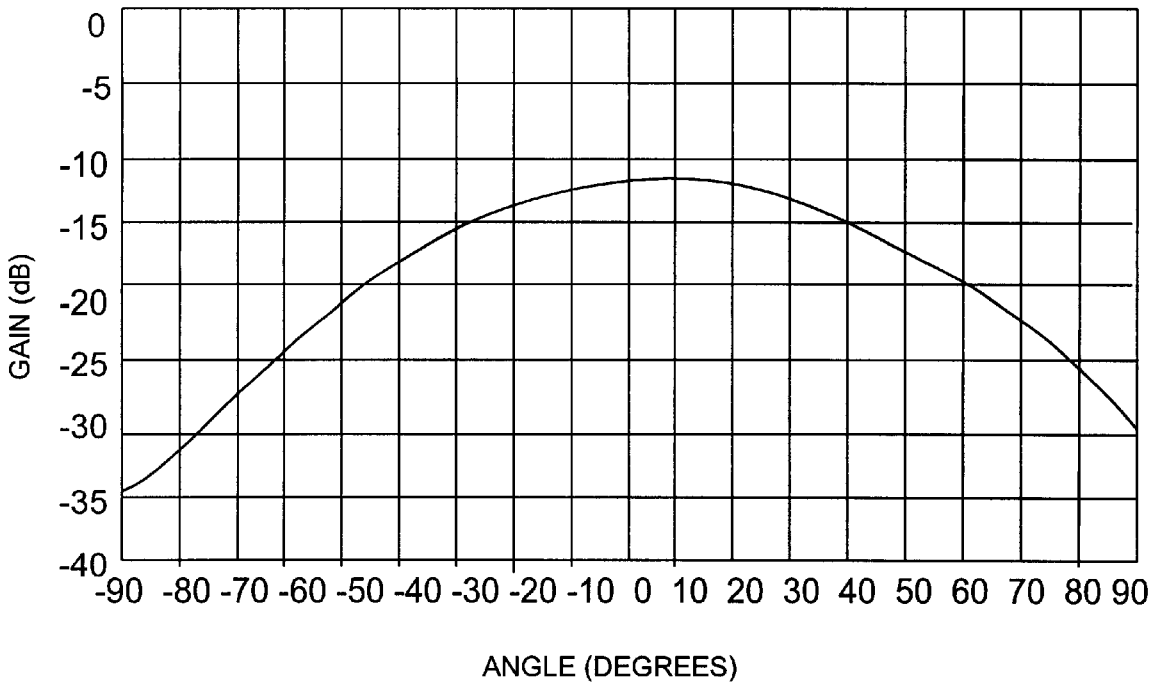
FIG. 6A shows the antenna response for a horizontally polarized full-fab configuration of a preferred embodiment of the present invention.
Figure 6B:
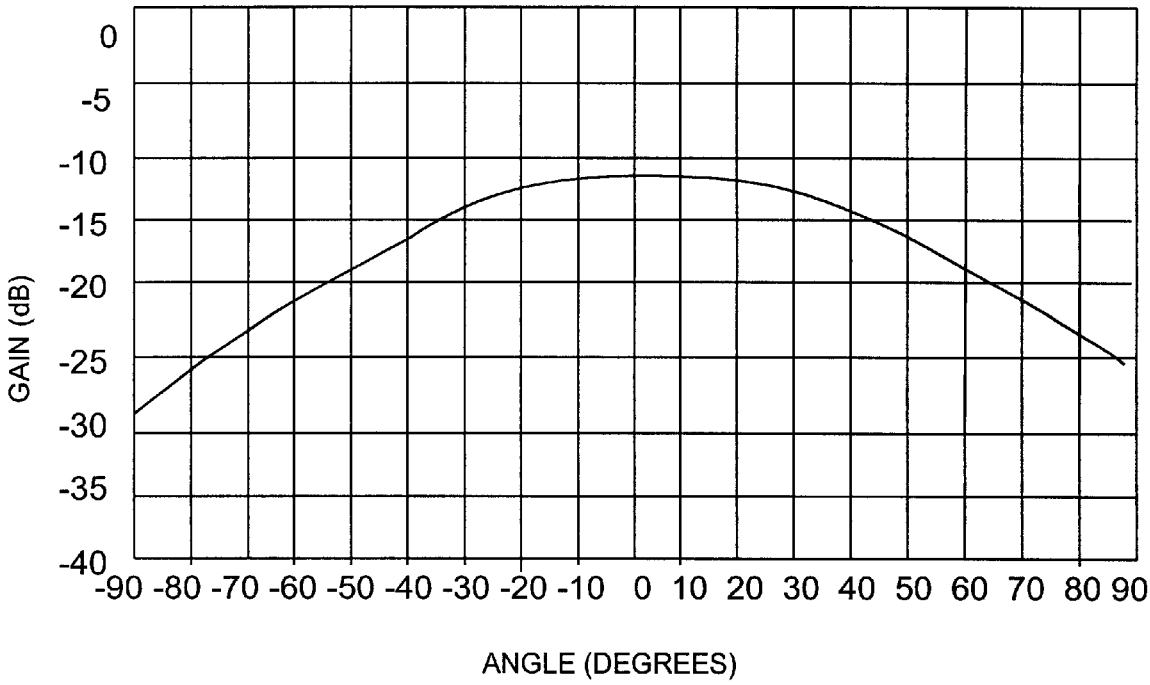
FIG. 6B shows the antenna response for a vertically polarized full-fab configuration of a preferred embodiment of the present invention.

A dimensionally smaller antenna patch is affected by shorting to ground one of the radiated sides of the conventionally designed (designated "full-fab") λ/2 or the smaller λ/4 antennas. When one side is shorted for either the λ/2 or the λ/4 antenna design these antennas are referenced as "half-fab" antennas, indicating a size one-half the length, L 103, of a conventional "full-fab" or "whole" antenna. The length, L 103, is the dimension across which the polarization 104 of the antenna 100 is defined. See *Antenna Engineering Handbook*, Johnson & Jasik, pp. 7-2 to 7-3. These "shorted" antenna patches were tested and results compared to tests run on "full size" antenna patches. FIG. 5A provides results for a half-fab horizontally-polarized antenna showing a fairly flat, low amplitude response suitable for use as an omni-directional antenna, for example. FIG. 5B provides results for a half-fab vertically-polarized antenna showing a peaked higher gain response, suitable for use as a high-gain directional antenna. In FIG. 6A, a peaked response for a full-fab horizontally polarized antenna indicates the same use of this horizontally polarized antenna as for the half-fab vertically polarized antenna of FIG. 5B. Conversely, results for the full-fab vertically polarized antenna shown in FIG. 6B parallel the results for the half-fab horizontally polarized antenna whose results are displayed in FIG. 5A.

This brief exploration of the capabilities of different configurations of cloth antennas demonstrates that, as with conventional antenna designs, these flexible fabric antennas are suitable for adaptation, through design manipulation, to a number of different missions. Depending on specific user requirements, any of the parameters in Eqns. 1–9 are manipulated to achieve a desired performance, size, composition, or other characteristic.

The above descriptions should not be construed as limiting the scope of the invention but as mere illustrations of preferred embodiments. For example, although examples discussed clothing and soft objects, the antennas may also serve a function as a covering for an irregularly shaped hard object, such as a radiosonde or sonobuoy. The scope shall be determined by appended claims as interpreted in light of the above specification.

We claim:

1. A flexible antenna system integrated into an cloth article, said flexible antenna system comprising:

a first conductive layer;

a second conductive layer;

an electromagnetically insulating layer affixed between said first and second conductive layers, said electromagnetically insulating layer being fabricated from an electromagnetic non-conducting fabric; and a connector, said connector providing a current path from said first conductive layer to an external device to said flexible antenna system;

wherein said second conductive layer is connected to an electromagnetic ground with said external device; and wherein said first and second conductive layers, and said insulating layer are integrated into said cloth article by stitching said first and second conductive layers, and said insulating layer into said cloth article.

2. The system of claim 1 wherein said first and second conductive layers, and said insulating layer provide an appearance approximately the same as that of said cloth article to create a camouflage effect within said cloth article.

3. The system of claim 1 wherein said cloth article is a garment insulating layer comprises a dielectric fabricated from an electromagnetically non-conducting fabric.

4. The system of claim 3 wherein said fabric is selected from the group consisting of: cotton, wool, polyester, felt, gabardine, POLARTEC®, GORE-TEX®, chin, broadcloth, canvas, and any combination thereof.

5. The system of claim 1 wherein said conductive layers comprise a flexible material having electromagnetically conductive properties.

6. The system of claim 5 wherein said conductive layers comprise a metalized flexible material.

7. The system of claim 1 wherein said conductive layers comprise a fabric having electromagnetically conductive properties.

8. The system of claim 7 wherein said conductive layers comprise a metallized fabric.

9. The system of claim 7 wherein said fabric is fabricated via a process selected from the group consisting of: coating fibers with an electromagnetically conductive material, interleaving fibers of an electromagnetically conductive material with fibers of a non-electromagnetically conductive material, spinning fibers of an electromagnetically conductive material, weaving fibers of an electromagnetically conductive material, chemically bonding fibers of an electromagnetically conductive material, physically bonding fibers of an electromagnetically conducting material, and thermally bonding fibers of an electromagnetically conductive material, or any combination thereof, wherein said fabric of said conductive layers may comprise a combination of an electromagnetically conductive material and a non-electromagnetically conductive fiber as part of a single composite fabric.

10. The system of claim 1 wherein said first conducting layer, said insulating layer, and said second conducting layer are oriented such that said insulating layer electromagnetically insulates said first conducting layer from said second conducting layer, and wherein said layers are bonded to form a single unit.

11. The system of claim 10 wherein said layers are bonded using a method selected from the group consisting of: bonding using an adhesive, thermal bonding, physical bonding, chemical bonding, and any combination thereof.

12. The system of claim 1 wherein said first conductive layer receives and transmits signals.

13. The system of claim 1 wherein said second conductive layer serves as a ground plane for said antenna.

14. The system of claim 10 whereby said system maintains its integrity after cleaning of a type selected from the group consisting of aqueous washing, non-aqueous washing, dry cleaning, and ultrasonic cleaning.

15. Apparel having a fabric into which a flexible antenna system is discreetly integrated, said flexible antenna system comprising:

a first conductive layer;

a second conductive layer;

an electromagnetically insulating layer affixed between said first and second conductive layers, said electromagnetically insulating layer being fabricated from an electromagnetic non-conducting fabric; and a connector, said connector providing a current path from said first conductive layer to an a external device to said flexible antenna system;

wherein said second conductive layer is connected to an electromagnetic ground with said external device; and wherein said first and second conductive layers, and said insulating layer are integrated into said apparel by stitching said first and second conductive layers, and said insulating layer into said apparel.

16. The apparel of claim 15 wherein said conductive layers comprise a fabric having electromagnetically conductive properties.

17. The apparel of claim 15 wherein said fabric for said conductive layers is fabricated via a process selected from the group consisting of: coating fibers with an electromagnetically conductive material, interleaving fibers of an electromagnetically conductive material with fibers of a non-electromagnetically conductive material, spinning fibers of an electromagnetically conductive material, weaving fibers of an electromagnetically conductive material, chemically bonding fibers of an electromagnetically conductive material, physically bonding fibers of an electromagnetically conducting material, and thermally bonding fibers of an electromagnetically conductive material, or any combination thereof, wherein said fibers of said conductive layers may comprise a combination of an electromagnetically conductive material and a non-electromagnetically conductive fiber as part of a single composite fabric.

18. The apparel of claim 15 wherein said conductive layers comprise a metallized fabric.

19. The apparel of claim 15 wherein said first and second conductive layers, and said insulating layer provide an appearance approximately the same as that of said apparel to create a camouflage effect within said apparel.

20. The apparel of claim 15 wherein said fabric is selected from the group consisting of: cotton, wool, polyester, felt, gabardine, POLARTEC®, GORE-TEX®, chin, broadcloth, canvas, and any combination thereof.

21. The apparel of claim 15 wherein said first conducting layer, said insulating layer, and said second conducting layer are oriented such that said insulating layer electromagnetically insulates said first conducting layer from said second conducting layer, and wherein said layers are bonded to form a single unit.

22. The apparel of claim 15 wherein said layers are bonded using a method selected from the group consisting of: bonding using an adhesive, thermal bonding, physical bonding, chemical bonding, and any combination thereof.

23. The apparel of claim 15 wherein said first conductive layer receives and transmits signals.

24. The apparel of claim 15 wherein said second conductive layer serves as a ground plane for said antenna.

25. The apparel of claim 15 whereby said apparel maintains its integrity after cleaning of a type selected from the group consisting of aqueous washing, non-aqueous washing, dry cleaning, and ultrasonic cleaning.

* * * * *